US006874393B2

(12) United States Patent
Kile

(10) Patent No.: US 6,874,393 B2
(45) Date of Patent: Apr. 5, 2005

(54) INTERNAL PIPE WRENCH

(75) Inventor: Albert J. Kile, Danville, IL (US)

(73) Assignee: Kile Machine & Tool, Inc., Danville, IL (US)

( * ) Notice: Subject to any disclaimer, the term of this patent is extended or adjusted under 35 U.S.C. 154(b) by 19 days.

(21) Appl. No.: 10/388,055

(22) Filed: Mar. 13, 2003

(65) Prior Publication Data

US 2004/0177732 A1 Sep. 16, 2004

(51) Int. Cl.[7] ..... B25B 23/08
(52) U.S. Cl. ..... 81/446; 81/442
(58) Field of Search ..... 81/442, 446, 443, 81/448, 449, 90.2

(56) References Cited

U.S. PATENT DOCUMENTS

| | | | | | |
|---|---|---|---|---|---|
| 1,251,408 | A | | 12/1917 | Murray | |
| 1,344,542 | A | | 6/1920 | Lane | |
| 1,790,761 | A | | 2/1931 | Ortolon | |
| 1,887,009 | A | | 11/1932 | Buttress | |
| 2,455,005 | A | | 11/1948 | Hall | |
| 2,468,867 | A | * | 5/1949 | Collins | 81/442 |
| 2,482,501 | A | | 9/1949 | Oravetz | |
| 2,573,327 | A | | 10/1951 | Gossard | |
| 2,627,773 | A | | 2/1953 | Barnett | |
| 2,800,043 | A | | 7/1957 | Young, Jr. | |
| 3,861,251 | A | * | 1/1975 | Streander | 81/439 |
| 4,335,632 | A | * | 6/1982 | Irwin et al. | 81/446 |
| 4,499,799 | A | | 2/1985 | Bordages | |
| 5,129,291 | A | * | 7/1992 | Poniatowski | 81/446 |
| 5,207,131 | A | | 5/1993 | Pool | |
| 6,675,679 | B2 | * | 1/2004 | Dugan | 81/446 |

* cited by examiner

*Primary Examiner*—Derris H. Banks
*Assistant Examiner*—J Williams
(74) *Attorney, Agent, or Firm*—David J. Bremer

(57) ABSTRACT

The invention is a pipe wrench product for rotating a hollow object, such as a pipe and a tube, by engaging the object interior. The product uses the interaction when contacting between shape-wise distinguishable curved driving and driven surfaces to control the direction of force transmitted from the product to the object. The product is designed to minimize any distortion to the shape of the object caused by the product and to maximize the turning force transmitted to the object by the product.

16 Claims, 8 Drawing Sheets

INTERNAL PIPE WRENCH

The invention is a pipe wrench product for rotating a hollow object, such as a pipe and a tube, by engaging the object interior. The product is designed to minimize any distortion to the shape of the object caused by the product and to maximize the tangential force transmitted to the object by the product.

The product is designed to automatically change a direction and a magnitude of a force transmitted to the pipe as needed to cause the pipe to rotate. Specifically, the product increases a tangential force applied to the pipe faster than a radial force. This enables the product to rotate the pipe without damaging and distorting the pipe.

Other types of pipe wrenches can provide varying amounts of force as needed to rotate the pipe, but the product is unique in its ability to change the magnitude and the direction of the force transmitted to the pipe.

The product can be used to rotate pipes, tubes and other hollow objects that can be interiorly engaged. For example, there is a need to rotate threaded pipes where the pipes are located in tight spaces. In tight spaces, it can be impractical to use a pipe wrench that grips a pipe around the pipe exterior.

There is also a need to rotate hollow objects that have an exterior surface that would be damaged by an exterior-gripping wrench. The product enables rotating such objects without contacting the exterior surfaces.

Also, the product is well adapted for use with high-speed impact and air tools. The product has a slender profile required to fit inside the pipe that reduces rotational inertia of the product, making the product easier to operate at high rotational speeds.

The product comprises a rotator and a shoe. In use, at least part of the shoe and the rotator are inserted in a pipe. Then the rotator is rotated from outside the pipe and contacts the shoe. The rotator applies a force on the shoe causing the shoe to rotate with the rotator and causing the shoe to move outwards from the rotator. When the shoe moves outwards it engages the pipe interior and transmits the force from the rotator to the pipe, causing the pipe to rotate with the rotator.

The product is designed to automatically change the direction and the magnitude of the force transmitted to the pipe as needed to cause the pipe to rotate. Specifically, the product increases the tangential force applied to the pipe faster than the radial force. This enables the product to rotate the pipe without damaging and distorting the pipe.

When the rotator rotates, the rotator and the shoe contact across a curved driving surface and at a curved driven surface. The rotator, via the contacting driving and driven surfaces, applies the force to the shoe, which transmits the force from the rotator to the pipe when the shoe engages the pipe.

The curved driven surface is shape-wise distinguishable from the curved driving surface. The term "shape-wise distinguishable" as used here and throughout means that a surface is recognizable from another surface due to one or more differences in size, curvature, concavity, convexity, and by various other shape-related characteristics.

The curved driving surface and the curved driven surface are devised to interact during contacting in such a way as to minimize the increase in radial force on the pipe and to maximize the increase in tangential force on the pipe.

The product can have multiple driving surface components and multiple driven surface components. The shoe can have multiple shoe components. Each of the shoe components can have a driven surface component for contacting one or more of the driving surface components.

In addition, the shoe has a separate curved gripping surface for interiorly engaging the pipe. The gripping surface distributes the force across the pipe interior where the gripping surface engages the pipe so that the product can rotate the pipe without damaging and distorting the pipe.

The curved gripping surface is shape-wise distinguishable from the curved driven surface.

The shoe can have multiple gripping surface components. Each of the shoe components can have a gripping surface component for interiorly engaging the pipe.

Figure 1:
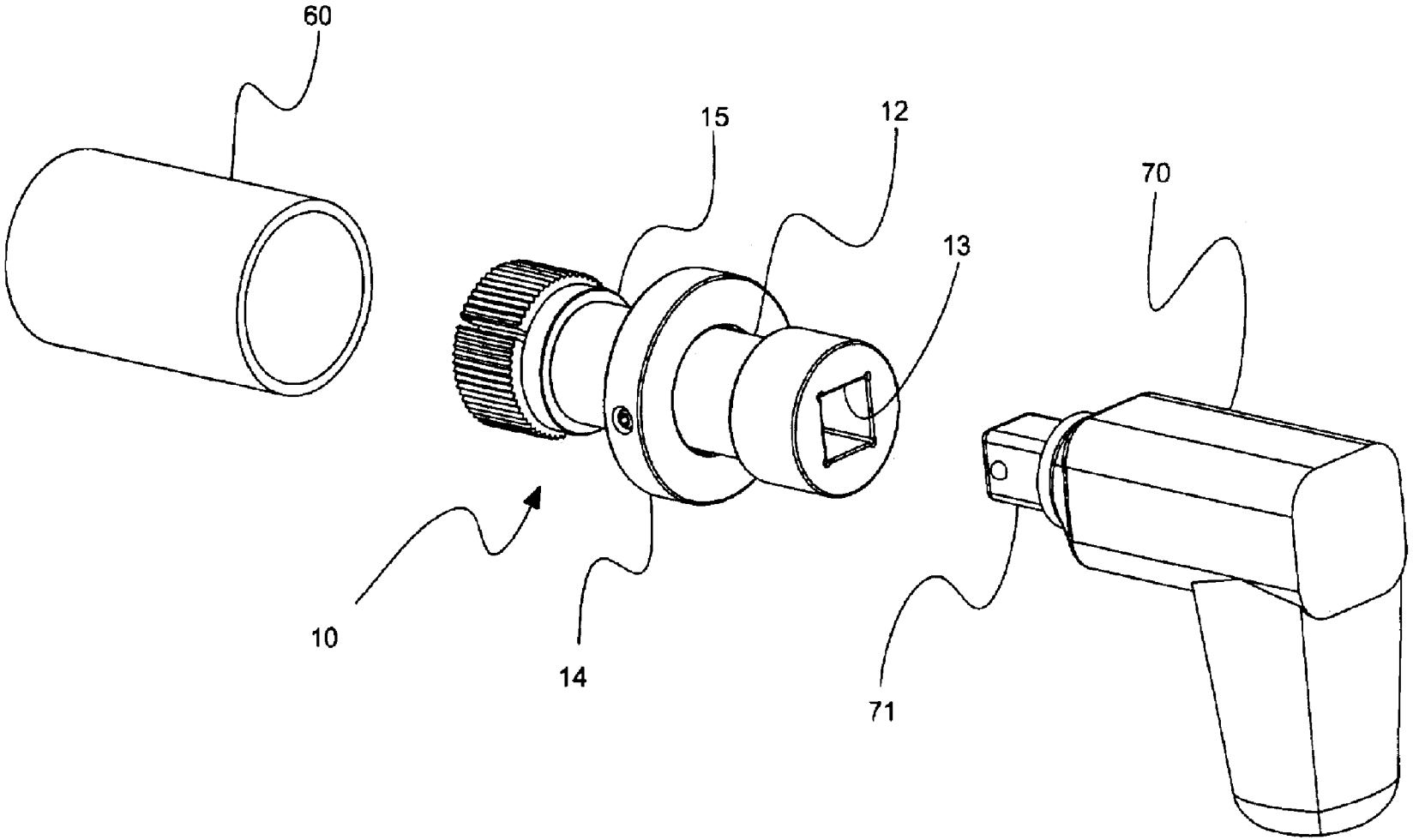
FIG. 1 depicts a perspective view of an assembled product positioned for insertion into a pipe.
Figure 2:
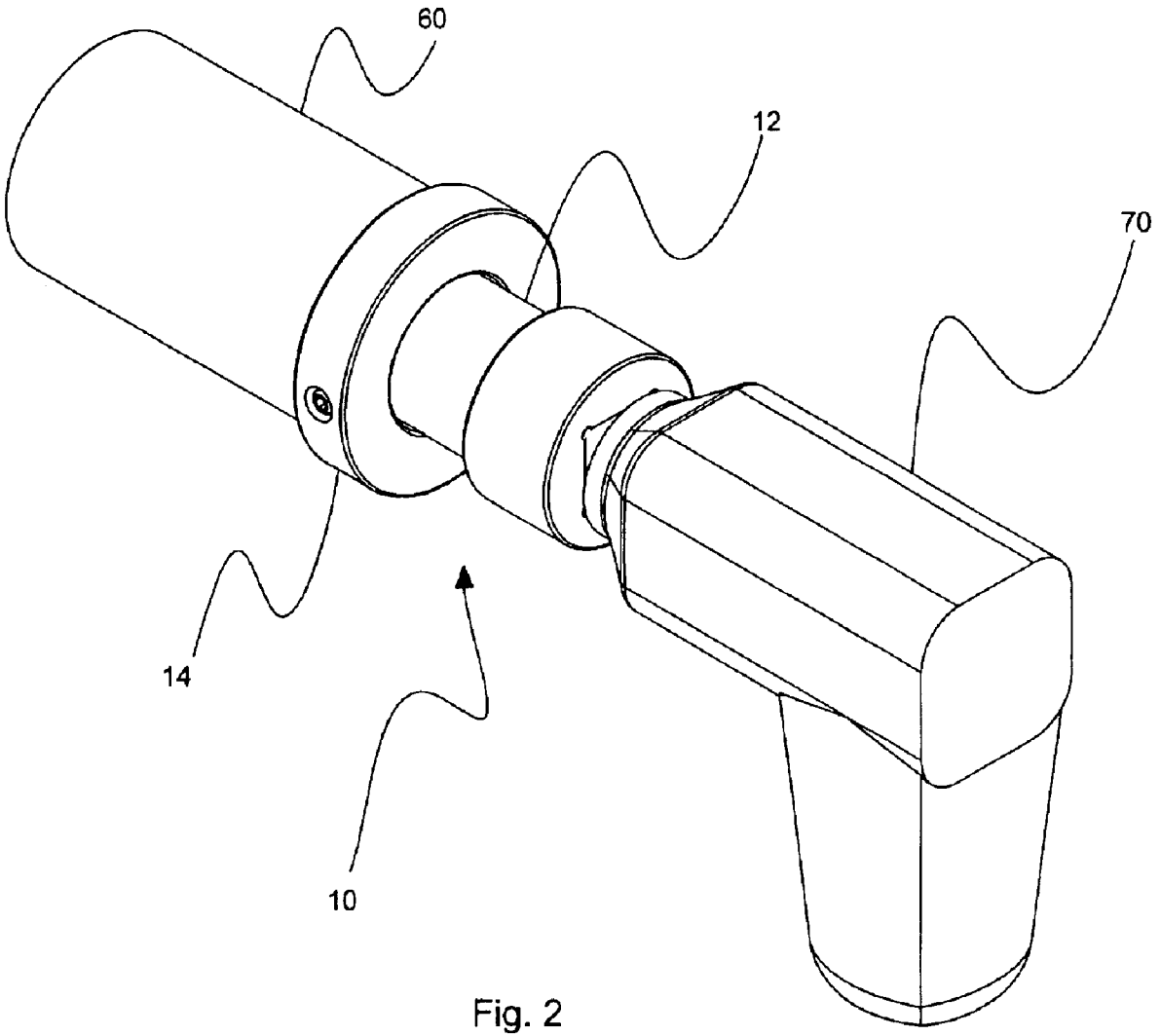
FIG. 2 depicts a perspective view of an assembled product inserted into a pipe.

In FIG. 1, a product 10 is positioned for inserting into a pipe 60. In FIG. 2, the product is inserted into the pipe and prepared to rotate the pipe. In use, the shoe covers at least a part of a distal end of a rotator, and the distal end and the shoe can be inserted into the pipe until the pipe contacts the adjustable collar 14. The collar 14 slides along a rotator shaft 12 extending from the distal end of the rotator.

A proximal end of the rotator can have a connector for rotating the rotator from outside the pipe. The rotator can have various types of connectors such as a standard square and hexagonal drive element, a knurled element, and other connecters adapted for rotating by various methods. In FIG. 1 and FIG. 2, the connector is a square drive pocket 13 for accepting a drive end 71 of an air wrench 70. The air wrench is one method for causing the rotator to rotate. Various methods can be used, such as a ratchet, a breaker bar, a chuck, a vise grip, a wrench, and other methods, as well as rotating by hand.

Figure 3:
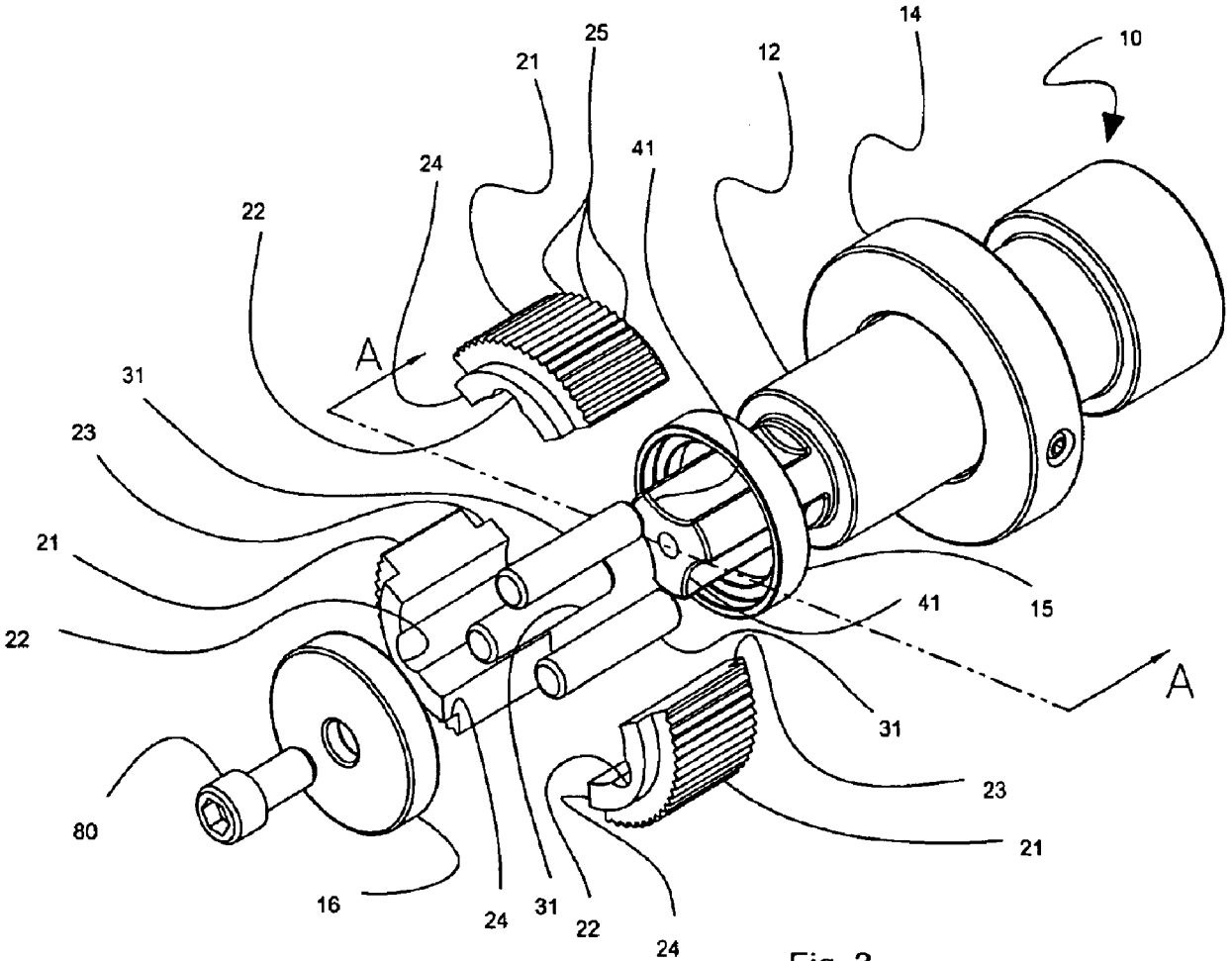
FIG. 3 depicts a perspective exploded view of another product configuration.

In FIG. 3, the product 10 is seen in exploded view showing various elements. The product 10 comprises three jaws 21, with three inward-facing seats 22, a curved driven surface comprising three driven surface components 31, and a rotator. The rotator has a curved driving surface comprising three driving surface components 41. The product 10 has a shoe comprising three shoe components. In this embodiment, a shoe component comprises the jaw 21, the seat 22, and the driven surface component 31, because they all move outward from the rotator when the rotator rotates.

In use, at least part of the shoe and part of the rotator are inserted in the pipe. Then the rotator is rotated in the preferred direction. When the rotator is rotated, the rotator and the shoe contact across the curved driving surface and at the curved driven surface. The rotator, via the contacting curved driving surface and curved driven surface, applies the force to the shoe.

The force has a forcing direction that is determined by the relative positions of the driving surface and the driven surface. The forcing direction is along an axis that is normal to the driving surface and normal to the driven surface where they contact each other.

Initially, when the force is applied, the shoe can move radially and tangentially along the forcing direction until the shoe engages the pipe at the pipe interior. After the shoe engages the pipe, the pipe resists the radial movement and the tangential movement of the shoe. Further rotating the rotator, after the shoe engages the pipe, causes the driving surface and driving surface to shift positions and travel across each other.

The respective shapes of the curved driving surface and the curved driven surface cause the surfaces to shift their positions when there is resistance to the force on the shoe, such as the resistance caused by inertia and the resistance caused by the pipe resisting the movement of the shoe. The curved driving surface and the curved driven surface are designed to shift positions so that the forcing direction turns more tangential when there is resistance to the force on the shoe.

By turning the forcing direction more tangential, the product reduces the ratio of radial force to tangential force on the shoe. This reduces the likelihood of excessive radial force causing distortion and damage to the pipe. Also, turning the forcing direction more tangential increases the amount of tangential force transmitted to the pipe, making the product more efficient.

Additional tangential force on the shoe is transmitted to the pipe, urging the pipe to rotate with the shoe and the rotator. Additional radial force on the shoe pushes the shoe outwards into the pipe, causing the pipe to distort, and generating heat and friction.

Excessive radial force can distort the shape of the pipe and can damage the pipe interior, for example by scratching, spalling, and gouging the pipe interior. Also, excessive radial force wastes energy by generating heat and excess friction.

Figure 4:
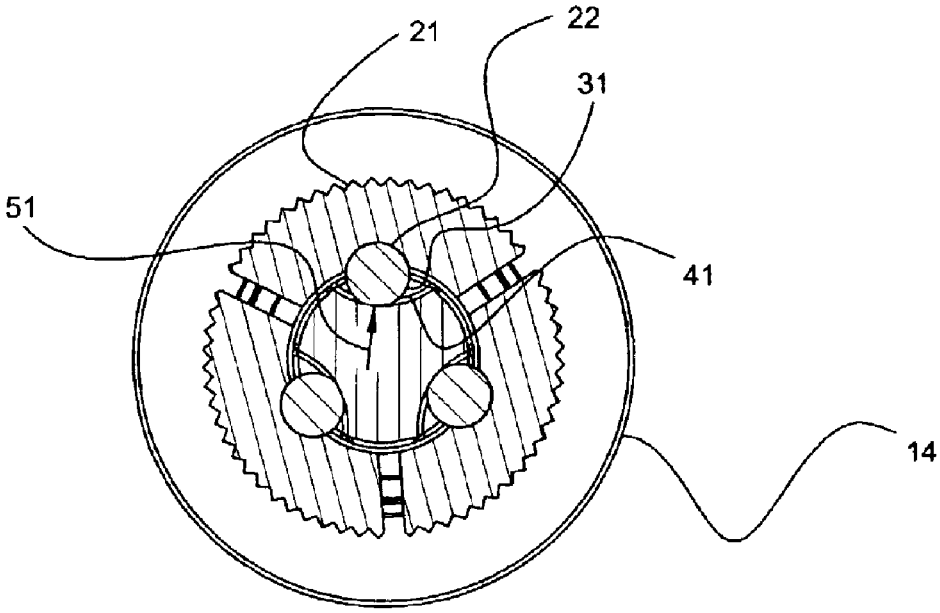
FIG. 4 depicts a section view across line A—A of the product configuration of FIG. 3 in the assembled condition.
Figure 5:
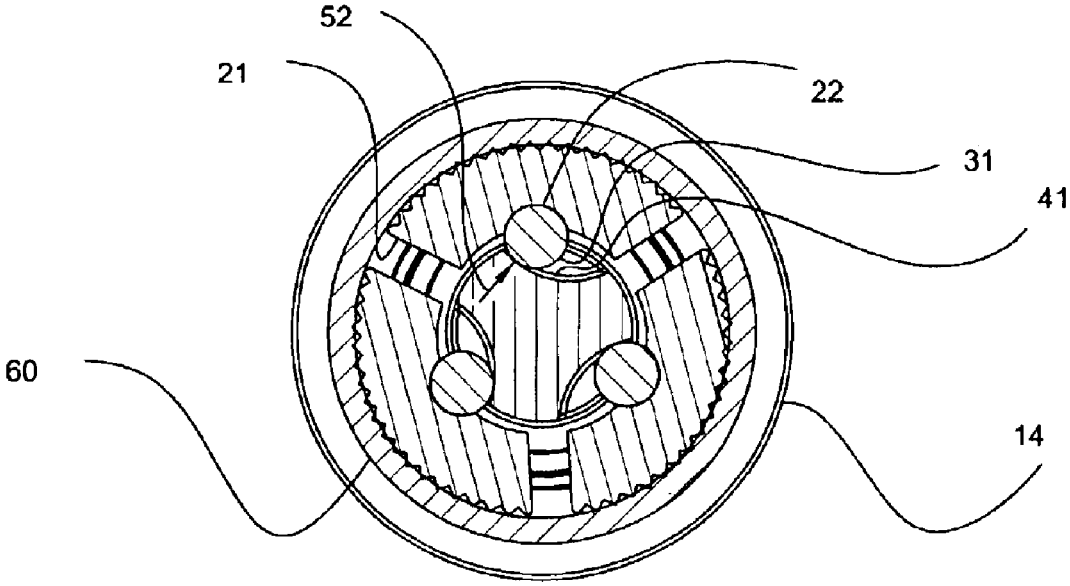
FIG. 5 depicts a section view across line A—A of the product configuration of FIG. 3 in use engaging a pipe interior.

The force characteristics, between the rotator and the shoe of product 10, are illustrated in FIG. 4 and FIG. 5. FIG. 4 is a section view across line A—A in FIG. 3 of the product 10 in the assembled condition, prior to being inserted in the pipe.

In the assembled condition, shown in FIG. 4, the driven surface component 31 is captured between the seat 22 and the driving surface component 41. The driven surface component 31 contacts the driving surface component 41 near the midpoint of the driving surface component. This arrangement enables the product to be inserted inside the pipe. A force 51 on the shoe is normal to the driven surface component 31 and the driving surface component 41 where they contact each other.

In FIG. 5, the product is shown inserted in the pipe 60 and with the rotator rotated so that the shoes have engaged the pipe. The driven surface component 31 has traveled across the driving surface component 41 toward the end of the driving surface component. A force 52 is normal to the driven surface component 31 and the driving surface component 41 where they contact, and the forcing direction has turned more tangential than the forcing direction of the force 51 shown in FIG. 4. Turning the forcing direction more tangential minimizes the increase in radial force after the shoe engages the pipe and helps the product transmit more tangential force to the pipe.

From FIG. 4 and FIG. 5, it is clear that the design of the curved driving surface and the curved driven surface is effective in turning the forcing direction to minimize radial force and maximize tangential force transmitted to the pipe. Any other configuration of contacting surfaces, such as a rectangular and polygonal configuration, would not turn the forcing direction more tangential to the degree provided by the curved driving surface and the curved driven surface of the product. Any other configuration of contacting surfaces would not reduce the ratio of radial force to tangential force on the shoe to the degree provided by the curved driving surface and the curved driven surface of the product.

Figure 6:
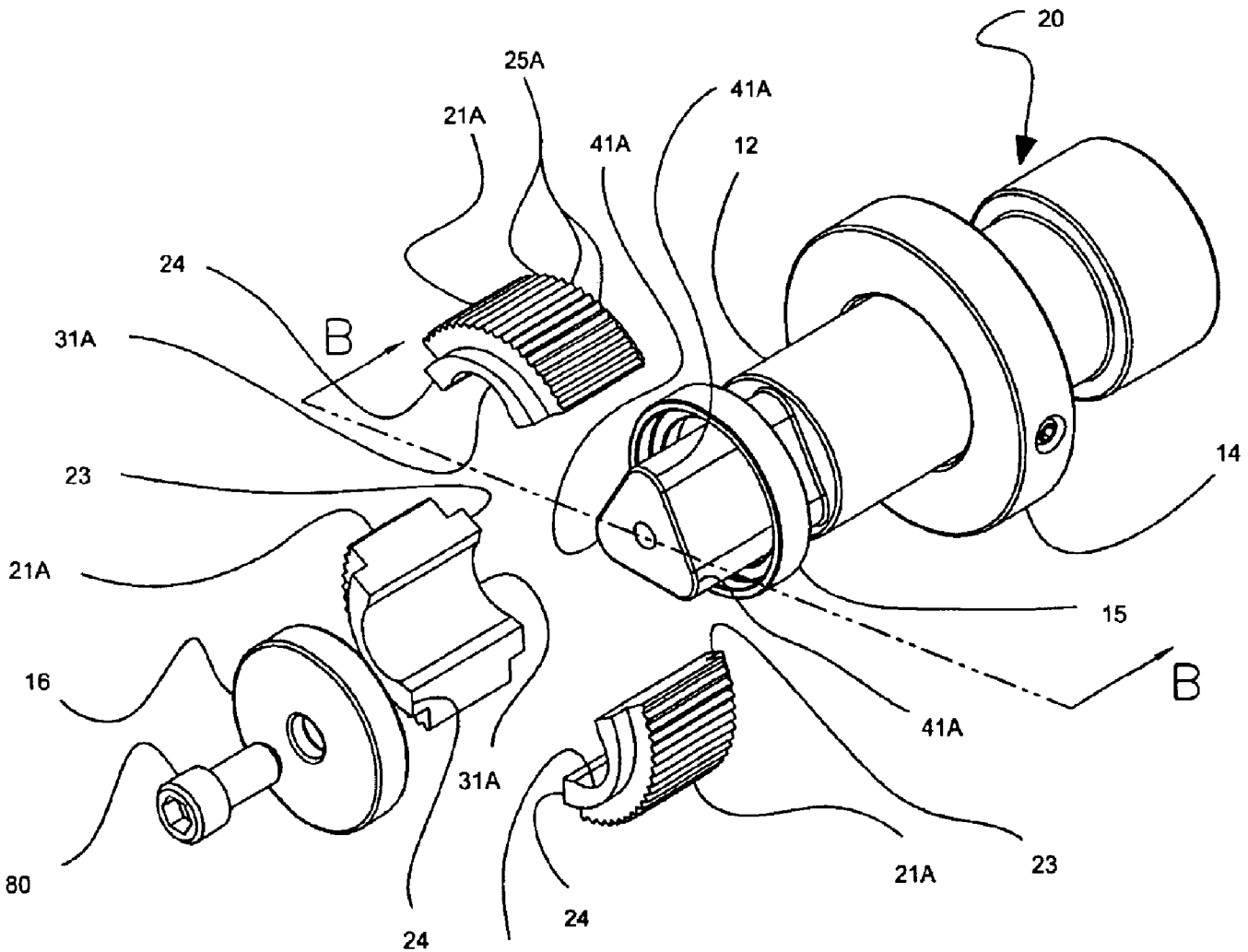
FIG. 6 depicts a perspective exploded view of another product configuration.

In FIG. 6, the product 20 has three jaws 21A, curved driven surface comprising three driven surface components 31A, and a rotator. The rotator has a curved driving surface comprising three diving surface components 41A. The product 20 has a shoe comprising three shoe components. In this embodiment, a shoe comprises the driven surface component 31A and the jaw 21A because they move outward from the rotator when the rotator rotates.

Figure 7:
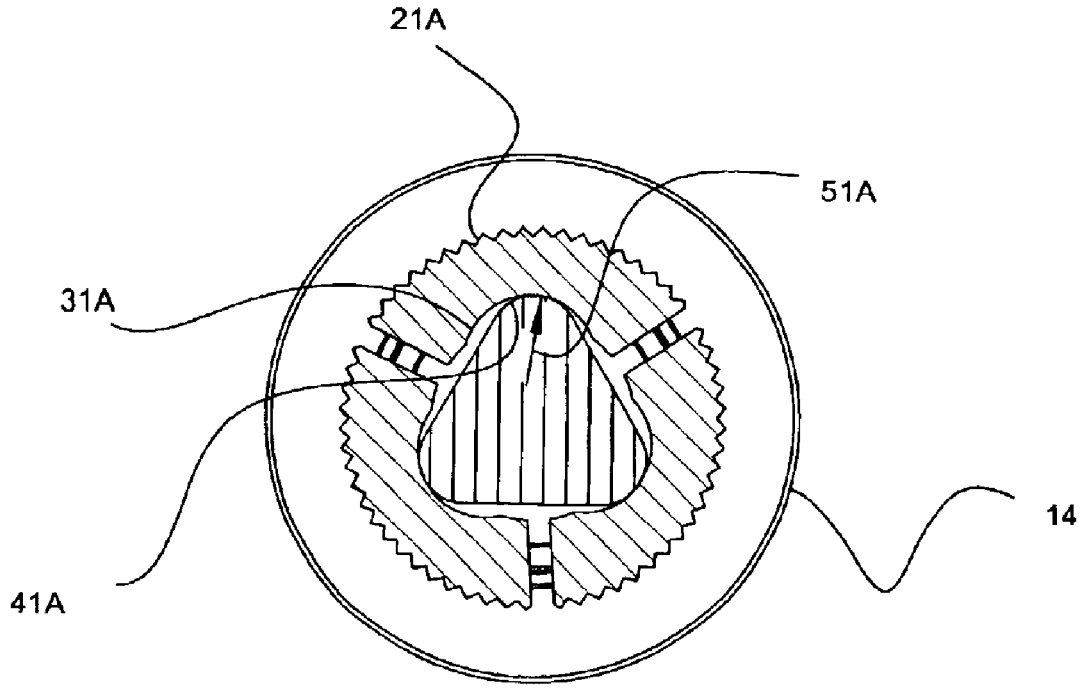
FIG. 7 depicts a section view across line B—B of the product configuration of FIG. 6 in the assembled condition.
Figure 8:
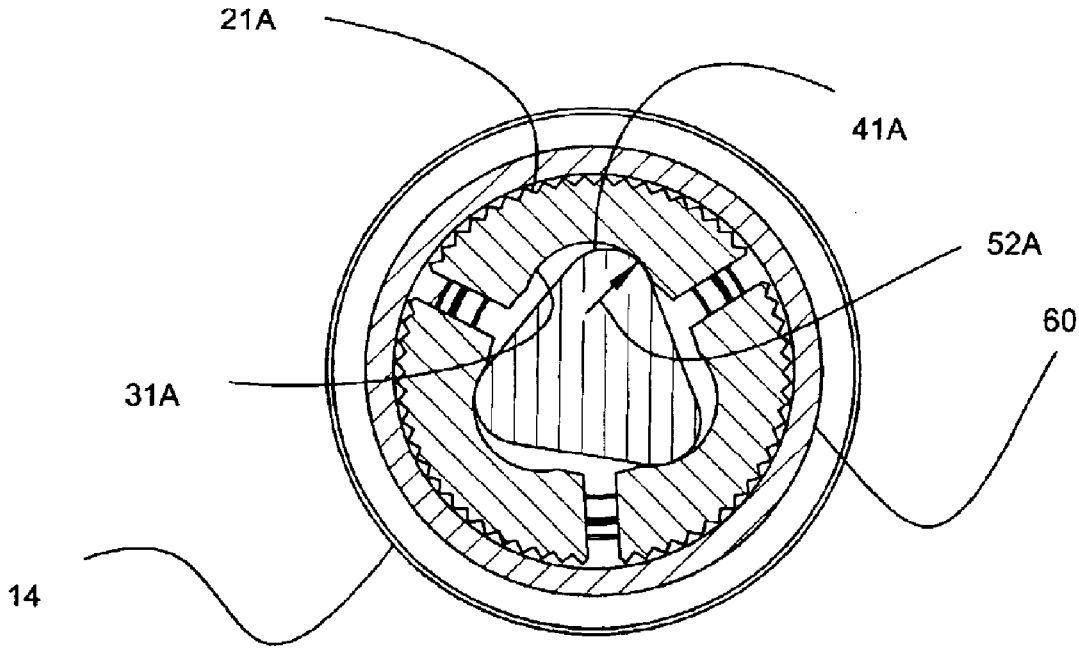
FIG. 8 depicts a section view across line B—B of the product configuration of FIG. 6 in use engaging a pipe.

The force characteristics, between the rotator and the shoe of the product 20, are illustrated in FIG. 7 and FIG. 8. FIG. 7 is a section view across line B—B in FIG. 6 of the product 20 in the assembled condition, prior to being inserted in the pipe. FIG. 8 is a similar section view of the product inserted in the pipe 60 and with the rotator rotated so that the shoes have engaged the pipe.

In FIG. 7 the driving surface component 41A contacts the driven surface component 31A near the midpoint of the driven surface component. This arrangement enables the product to be inserted inside the pipe. A force 51A on the shoe is normal to the driven surface component 31A and to the driving surface component 41A where they contact each other.

In FIG. 8, the product 20 is shown inserted in the pipe 60 and with the rotator rotated so that the shoes have engaged the pipe. The driving surface component 41A has traveled across the <first surface component> driven surface component 31A toward the end of the driven surface component. A force 52A is normal to the driven surface component 31A and to the driving surface component 41A where they contact, and the forcing direction has turned more tangential than the forcing direction of the force 51A shown in FIG. 7. Turning the forcing direction more tangential minimizes the increase in radial force after the shoe engages the pipe and helps the product transmit more tangential force to the pipe.

From FIG. 7 and FIG. 8, it is clear that the design of the curved driving surface and the curved driven surface is effective in turning the forcing direction to minimize radial force and maximize tangential force transmitted to the pipe. Any other configuration of contacting surfaces, such as a rectangular and polygonal configuration, would not turn the forcing direction more tangential to the degree provided by the curved driving surface and the curved driven surface. Any other configuration of contacting surfaces would not reduce the ratio of radial force to tangential force on the shoe to the degree provided by the curved driving surface and the curved driven surface of the product.

The product comprises at least one at least one curved driving surface and at least one curved driven surface. The <first surface> driven surface can be concave and convex. The driving surface can be concave and convex. The driven surface can have more than one driven surface component, and the driving surface can have more than one driving surface component. The product can have more than one driven surface and more than one driving surface. The driven surface can contact one or more driving surfaces. Alternatively, the driving surface can contact one or more driven surfaces.

Figure 9:
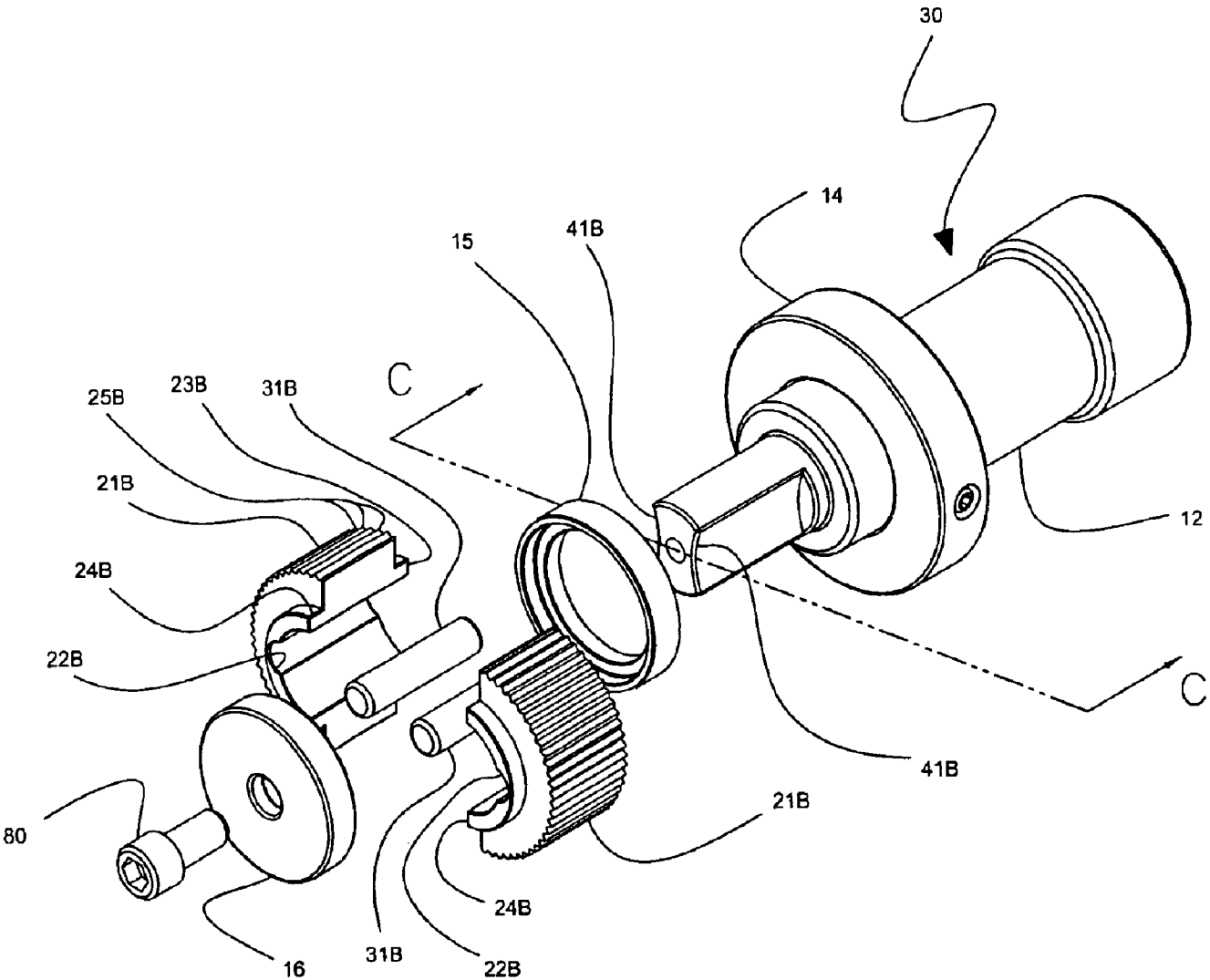
FIG. 9 depicts a perspective exploded view of another product configuration.

The driven surface can be a separate entity as shown in FIG. 3 and FIG. 9, where the driven surface is separate and cylindrically curved. Alternatively, the driven surface can be ellipsoidally curved, spheroidally curved, spherically curved, arbitrarily curved and combinations thereof.

The driving surface can be a separate entity. Alternatively, the driving surface can be cylindrically curved, elipsoidally curved, spheroidally curved, spherically curved, arbitrarily curved and combinations thereof.

In FIG. 9, the product 30 comprises two jaws 21B, with two inward-facing seats 22B, a curved driven surface with two driven surface components 31B, and a rotator. The rotator has a curved driving surface comprising two driving surface components 41B. The product 30 has a shoe comprising two shoe components. In this embodiment a shoe comprises the jaw 21B, the seat 22B, and the driven surface component 31B, because they more outward from the rotator when the rotator rotates.

Figure 10:
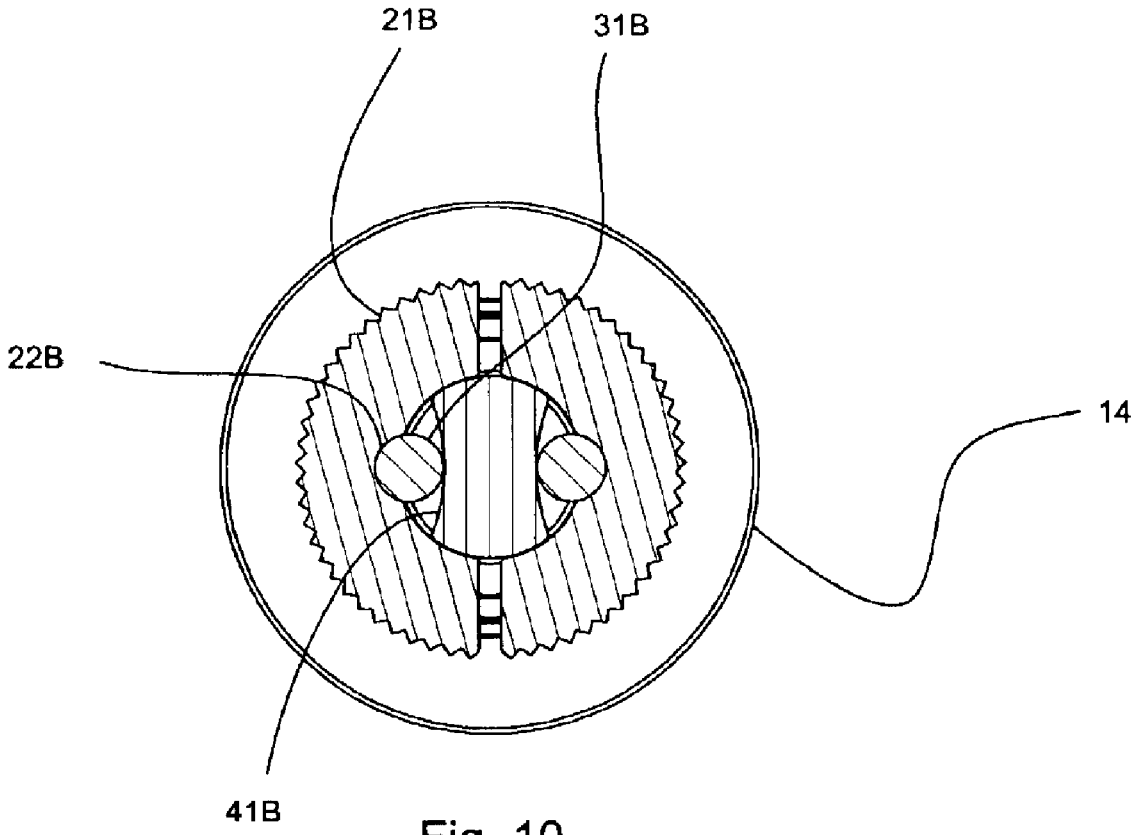
FIG. 10 depicts a section view across line C—C of the product configuration of FIG. 9 in the assembled condition.

In the assembled condition, shown in FIG. 10, the driven surface component 31B is captured between the seat 22B and the driving surface component 41B.

The force characteristics, between the rotator and the shoe of product 30, are similar to those of the product 10.

The shoe can have more than one shoe component. The products 10, 20 each have three shoe components. The product 30 has two shoe components. Other product configurations can have one, two, three or more shoe components.

The shoe, as shown in FIG. 3, FIG. 6, and FIG. 9, has an outward-facing curved gripping surface that engages the pipe interior. The curved gripping surface can comprise a plurality of gripping surface components. shoes of products 10, 20, 30 have outward-facing gripping surfaces components, for example the gripping surfaces 25, 25A, 25B.

The outward-facing gripping surface can have various configurations. For example, the outward-facing gripping surface can be machined, knurled, and ground. Abrasives can be applied to the outward-facing gripping surface in various ways, such as by embedding in the surface and by bonding with adhesives.

Some configurations, for example machined, knurled, and various other configurations, can result in the gripping surface and the gripping surface components being substantially textured, rough, and otherwise discontinuous. It is understood that the meaning of curved gripping surface as used here and throughout includes such textured, rough, and discontinuous surfaces so long as an outermost perimeter of the gripping surface substantially approximates a curve.

The outward-facing curved gripping surface can have various shapes. The shoes of products 10, 20, 30 have outward-facing curved gripping surfaces shaped substantially cylindrically for engaging the cylindrical pipe interior. Alternatively, the outward-facing curved gripping surface can be ellipsoidally curved, arbitrarily curved, and combinations thereof.

The shoe can have segmented jaws as in products 10, 20, and 30. Alternatively, the shoe can have jaws that encircle the rotator. Alternatively, the show can have jaws stacked axially along the rotator length. Various shoe configurations can be used, so long as the shoe is moved outward from the rotator by the action of contacting non-similar curvilinear surfaces, as described. The product can have more than one shoe.

The rotator can have a shaft extending from the curved driving surface. The products 10, 20, and 30, have a cylindrical shaft 12.

The rotator can have a connector for rotating the rotator from outside the pipe. The connector can have various configurations; such as a male square drive feature, a hexagonal drive socket, a knurled feature, a T-slot, and combinations thereof. Alternatively, the connector can be any feature that enables rotating from outside the pipe. In FIG. 1, the connector is the square drive socket 13.

The product can have a depth controller for controlling how deep the product is inserted into the pipe. As shown in FIGS. 1, 2, 3, 6, and 9, the depth controller is an adjustable collar 14. The collar 14 is designed to slide along the shaft of the rotator. The collar 14 can be fixed in place by a setscrew. Various other methods for controlling the depth of insertion can be used.

The product can have means for limiting the axial movement and the radial movement of the shoe. In FIGS. 1, 3, 6, and 9, the shoe movement is limited axially and limited radially by a lower cap 15 and an upper cap 16. In use, the upper cap and lower cap hold the shoe in the assembled condition.

The upper can and lower cap are designed to enable the shoe to collapse inward so that it can be inserted in the pipe, and permit the shoe to expand outward so that it can engage the interior of the pipe. Various other methods for limiting the axial movement and the radial movement of the shoe can be used.

The lower cap 15 fits over the rotator and rests on a shoulder at the end of the shaft 12. The lower cap has a circular pocket that captures the flange 23, 23A, 23B, on the end of the jaw 21, 21A, 21B, respectively.

The upper cap 16 sits against the end of the rotator. The upper cap has a circular pocket that captures the flange 24, 24A, 24B, on the end of the jaw 21, 21A, 21B, respectively.

The upper cap can be held in place by a fastener 80 and by various other methods such as a clip, a resilient element, by magnetic means, by threading the upper cap and the rotator, and combinations thereof.

What is claimed is:

1. An interiorly engaging pipe wrench product having force transmission elements devised to minimize distortion of a pipe, the product comprising:

a rotator, the rotator having a curved driving surface;

a shoe, the shoe having a curved driven surface;

the driven surface being shape-wise distinguishable from the driving surface;

the shoe contacting the rotator across the driving surface and at the driven surface;

the shoe in use moving outward from the rotator to interiorly engage the pipe;

the shoe having a outward-facing, curved, gripping surface, the gripping surface being shape-wise distinguishable from the driven surface;

the gripping surface in use interiorly engaging the pipe; and the curved driving surface and the curved driven surface having been devised to interact during contacting so as to minimize the increase in radial force on the pipe and to maximize the increase in tangential force on the pipe after the shoe engages the pipe.

2. The product of claim 1 wherein the driven surface is concave.

3. The product of claim 1 wherein the driven surface is convex.

4. The product of claim 1 wherein the driven surface is cylindrically curved.

5. The product of claim 1 wherein the driven surface is spheroidally curved.

6. The product of claim 5 wherein the driven surface is spherically curved.

7. The product of claim 1 wherein the shoe comprises:

a plurality of shoe components, any shoe component from the plurality of shoe components being interchangeable with any other shoe component from the plurality of shoe components.

8. An interiorly engaging pipe wrench product having force transmission elements devised to minimize distortion of a pipe, the product comprising:

a rotator, the rotator having a curved driving surface;

a shoe, the shoe comprising:

a curved driven surface, the driven surface being shape-wise distinguishable from the driving surface;

a seat for positioning the driven surface;

the shoe contacting the rotator across the driving surface and at the driven surface;

the shoe in use moving outward from the rotator to interiorly engage the pipe;

the shoe further comprising an outward-facing, curved, gripping surface, the gripping surface being shape-wise distinguishable from the driven surface;

the gripping surface in use interiorly engaging the pipe; and the curved driving surface and the curved driven surface having been devised to interact during contacting so as to minimize the increase in radial force on the pipe and to maximize the increase in tangential force on the pipe after the shoe engages the pipe.

9. The product of claim 8 wherein the driven surface is concave.

10. The product of claim 8 wherein the driven surface is convex.

11. The product of claim 8 wherein the driven surface is cylindrically curved.

12. The product of claim 8 wherein the driven surface is spheroidally curved.

13. The product of claim 12 wherein the driven surface is spherically curved.

14. An interiorly engaging pipe wrench product having force transmission elements devised to minimize distortion of a pipe, the product comprising:

a rotator, the rotator having a curved driving surface comprising:

a plurality of curved driving surface components, any driving surface component being interchangeable with any other driving surface component from the plurality of driving surface components;

a shoe comprising, a plurality of shoe components, any shoe component being interchangeable with any other shoe component from the plurality of shoe components;

the any shoe component having a curved driven surface;

the curved driven surface being shape-wise distinguishable from the any curved driving surface component;

the any shoe component contacting the rotator across at least one driving surface component and at at least one driven surface component;

the any curved driving surface component and the any curved driven surface component having been devised to interact during contacting so as to minimize the increase in radial force on the pipe and to maximize the increase in tangential force on the pipe after the shoe engages the pipe;

the shoe further comprising:

an outward-facing, curved gripping surface comprising a plurality of outward-facing, curved gripping surface components, any curved gripping surface component being interchangeable with any other curved gripping surface component from the plurality of curved gripping surface components;

the any curved gripping surface component being shape-wise distinguishable from the any curved driven surface component; and the curved gripping surface in use interiorly engaging the pipe.

15. The product of claim 14 wherein any driven surface component is cylindrically curved.

16. The product of claim 14 wherein any driven surface component is spheroidally curved.

* * * * *